United States Patent [19]

Kokubo et al.

[11] Patent Number: 4,657,846

[45] Date of Patent: Apr. 14, 1987

[54] SILVER HALIDE PHOTOGRAPHIC PRINTING PAPER

[75] Inventors: Tadayoshi Kokubo; Tadashi Ikeda; Keiichi Adachi; Masaki Okazaki; Tetsuo Yoshida, all of Kanagawa, Japan

[73] Assignee: Fuji Photo Film Co., Ltd., Kanagawa, Japan

[21] Appl. No.: 684,318

[22] Filed: Dec. 20, 1984

[30] Foreign Application Priority Data

Dec. 22, 1983 [JP] Japan ..... 58-242718

[51] Int. Cl.[4] ..... G03C 1/19; G03C 1/06

[52] U.S. Cl. ..... 430/434; 430/428; 430/429; 430/538; 430/585; 430/588; 430/933; 430/564

[58] Field of Search ..... 430/933, 139, 588, 546, 430/434, 428, 429, 538, 585, 564

[56] References Cited

U.S. PATENT DOCUMENTS

| | | | |
|---|---|---|---|
| 3,406,070 | 10/1968 | Oetiker et al. | 430/933 |
| 3,428,455 | 2/1969 | Kitze | 430/588 |
| 3,434,837 | 3/1969 | Knott et al. | 430/933 |
| 3,499,762 | 3/1970 | Cressman et al. | 430/933 |
| 3,694,217 | 9/1972 | Sakaguchi et al. | 430/933 |
| 3,705,809 | 12/1972 | Nakazawa et al. | 430/588 |
| 3,706,570 | 12/1972 | Nakazawa et al. | 430/588 |
| 3,953,215 | 4/1976 | Hinata et al. | 430/139 |
| 4,172,730 | 10/1979 | Hinata et al. | 430/588 |

*Primary Examiner*—Won H. Louie

*Attorney, Agent, or Firm*—Sughrue, Mion, Zinn, Macpeak, and Seas

[57] ABSTRACT

A silver halide photographic light-sensitive materials are described. In silver halide photographic printing paper comprising at least one silver halide photographic emulsion layer applied to a water impermeable reflective base, the printing paper of the present invention is in the improvement wherein said silver halide emulsion layer is spectrally sensitized with at least one cyanine dye represented by general formulae I and II, and an emulsified dispersion or latex dispersion of a water insoluble fluorescent whitening agent contained in a hydrophilic vehicle of at least one layer applied to the base on the same side as said silver halide emulsion layer:

I

II wherein $Y_1$ and $Y_2$ each represents an O atom, —N—$R_7$ or a S atom, wherein $R_7$ represents a lower alkyl group, A represents H or a lower alkyl group having 4 or less carbon atoms, $R_1$, $R_2$, $R_3$ and $R_4$ each represents —H, —$CH_3$, —$OCH_3$, —$C_2H_5$, —$OC_2H_5$, —CN, —Cl, —F, —$CF_3$, —COOH, —$COOCH_3$ or —$COOC_2H_5$, $R_5$ and $R_6$ each represents substituted or non-substituted lower alkyl group, but at least one of $R_5$ and $R_6$ is substituted by a sulfo group, and X represents an anionic residue.

19 Claims, No Drawings

SILVER HALIDE PHOTOGRAPHIC PRINTING PAPER

FIELD OF THE INVENTION

The present invention relates to silver halide photographic light-sensitive materials and, in detail, to a spectrally sensitized silver halide printing paper which has been subjected to fluorescent whitening.

BACKGROUND OF THE INVENTION

Hitherto, a fluorescent whitening process has been generally used for the purpose of increasing whiteness of a finished photographic printing paper. As compounds having such a fluorescent whitening effect, a great number of compounds are known and various methods of using them are also known.

One method is to add a fluorescent whitening agent to a paper base. In another method, a fluorescent whitening agent is added to a development processing solution, whereby it is applied to the printing paper in a development processing step. Further, it is known to add the fluorescent whitening agent to a light-sensitive material by blending it with a hydrophilic vehicle of a layer of the light-sensitive material.

In the case of adding a fluorescent whitening agent to the base, if it is applied to a polyethylene laminated paper base, there are problems in production, namely, the fluorescent whitening agent is easily thermally decomposed when it is added to a laminate layer fusing at high temperature.

In incorporating the fluorescent whitening agent in a development processing bath, there are problems in that it is not only difficult to use (because development conditions should be precesely controlled to retain the fluorescent whitening effect of the finished product constant) but also this procedure generally does not sufficient emphasize the white background of the prints. From such viewpoint, adding the fluorescent whitening agent to a hydrophilic vehicle of the light-sensitive material is preferred.

As fluorescent whitening agents used for this last method, there are, for example, sulfonated stilbene whitening agents as described in U.S. Pat. No. 2,933,390, Japanese Patent Publication No. 30495/73 and Japanese Patent Application (OPI) No. 135833/80 (The term "OPI" as used herein refers to a "published unexamined Japanese Patent Application".), etc., as water soluble agents. As water insoluble agents, stilbene type, coumarone type and thiophene type whitening agents are widely used. In the case of water soluble fluorescent whitening agents, it is advantageous to use the same together with a water soluble polymer such as polyvinyl pyrrolidone as described in Japanese Patent Publication No. 7127/59 or *Research Disclosure,* No. 17159 to prevent the fluorescent whitening agent from flowing out of the layer during development processing and in any subsequent water washing step, or to alter the molecular structure of the fluorescent whitening agent so that the same hardly flows out as described in Japanese Patent Application (OPI) No. 32547/81 (corresponding to U.S. Pat. Nos. 4,336,326 and 4,302,579) or European Pat. No. 0024380B1.

Examples of the water soluble fluorescent whitening agents used as described above include the following.

(1)

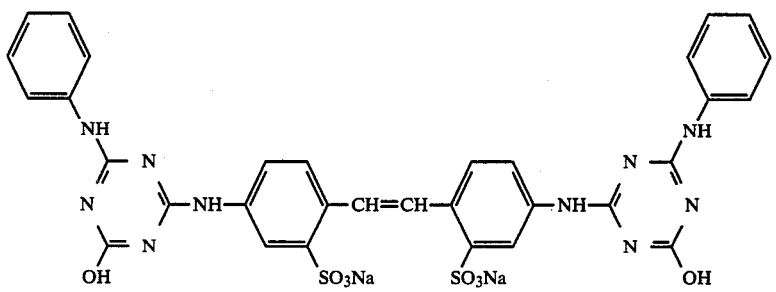

(2)

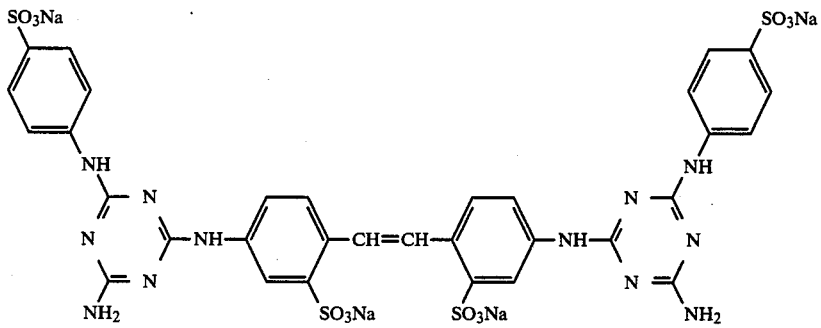

-continued

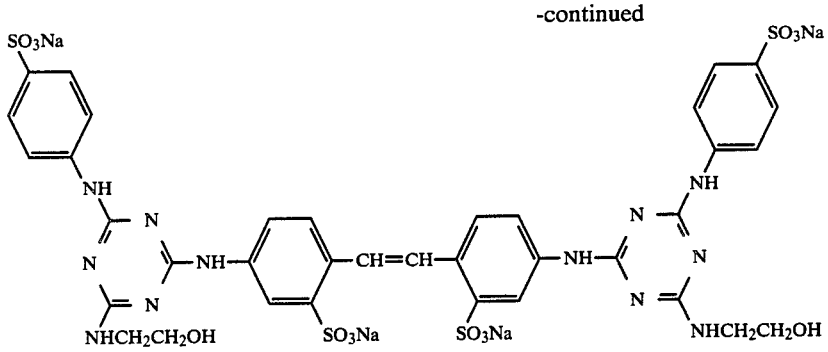

(3)

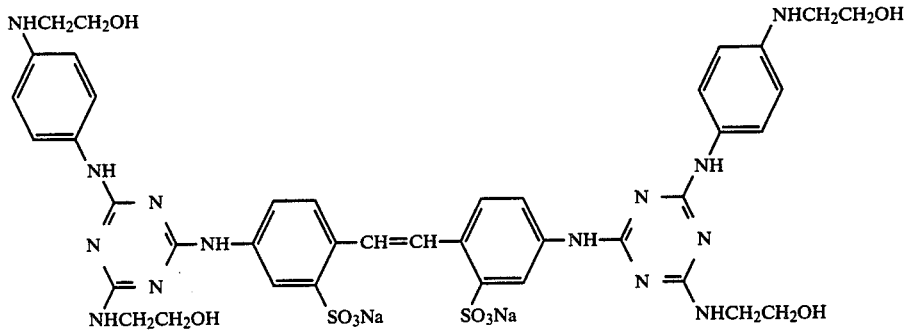

(4)

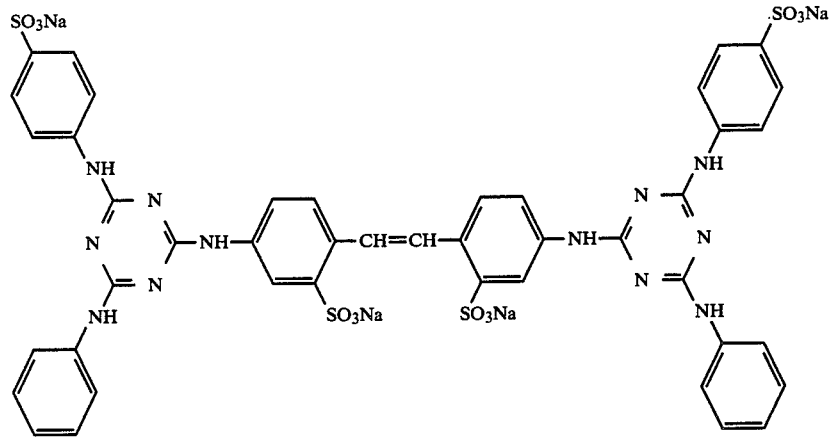

(5)

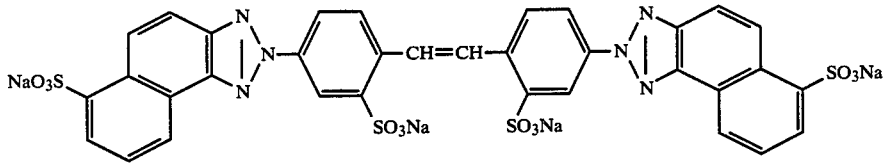

(6)

On the other hand, it is well known to carry out spectral sensitization to adapt a photographic printing paper for, for example, high speed monochromatic for photo-type setting use or color prints, etc. In order to carry out spectral sensitization, many sensitizing dyes, including cyanine and merocyanine dyes, have been put in practical use.

It is also important to shorten the time of development processing from the viewpoint of compensating for the fault of silver halide photographic systems of requiring high labor and substantial time for development processing as compared with other recording material. However, with the wide use of laminated paper as a printing paper base and the use of rapid development processing with automatic development devices, spectrally sensitized printing paper sometimes causes the problem of residual color due to sensitizing dyes which deteriorates the whiteness of the finished print. Particularly, in high temperature rapid development processing, especially with short time processing where the washing time is 30 seconds or less, residual color due to sensitizing dye(s), not heretofore a serious problem, has become a problem.

On the other hand, in order to overcome the problem of residual color caused by rapid processing, there is a technique of increasing apparent whiteness using water soluble fluorescent whitening agents as described in, for example, Japanese Patent Application (OPI) No. 135833/80.

However, the present inventors found that whiteness is deteriorated by incorporating a water soluble fluorescent whitening agent in a hydrophilic vehicle because residual color due to sensitizing dyes can increase depending upon the kind of sensitizing dye(s) used.

Further, it has been found that this last mentioned problem is related to the conditions of fixing processing and it remarkably occurs in the case of carrying out acid hardening fixing using polyvalent metal salts such as alum, etc.

It was unexpected that fluorescent whitening agents would increase residual color with certain kinds of sensitizing dyes and it has not heretofore been known what combination of structures cause such problem.

Further, in the case of using sensitizing dyes of the present invention as described hereinafter, when the fluorescent whitening agents of U.S. Pat. No. 2,933,390, Japanese Patent Publication No. 30495/73 and Japanese Patent Application (OPI) No. 135833/80 are added to the hydrophilic vehicle, residual color remarkably increases regardless of the layer to which they are added. However, in case of merocyanine dyes, such as phenomenon is not observed. Accordingly, it is believed that the increase in residual color is a peculiar phenomenon with cyanine dyes. Of the cyanine dyes, those which have only substituents having a low molecular weight and have at least one sulfoalkyl group are suitable for rapid processing because they seldom cause residual color. However, such dyes normally cause a remarkable increase in residual color in combination with a fluorescent whitening agents.

SUMMARY OF THE INVENTION

Accordingly, one object of the present invention is to provide silver halide photographic printing paper suitable for rapid processing which is spectrally sensitized with cyanine dyes and gives a high finished whiteness.

Another object of the present invention is to provide silver halide photographic printing paper which is spectrally sensitized with cyanine dyes and gives high finished whiteness even if it is subjected to development processing including acid hardening fixing using polyvalent metal salts.

A further object of the present invention is to provide a process for producing printing paper which is spectrally sensitized with cyanine dyes and contains a fluorescent whitening agent in a hydrophilic vehicle thereof.

The above described objects of the present invention have been attained by providing printing paper having at least one silver halide photographic emulsion layer applied to a water impermeable reflective base, wherein the silver halide emulsion layer is spectrally sensitized with at least one cyanine dye represented by general formula I or II, and an emulsified dispersion or latex dispersion (hereafter often jointly referred to as a dispersed composition) of a water insolube fluorescent whitening agent is present in a hydrophilic vehicle of at least one layer applied to the base on the same side as the silver halide emulsion layer:

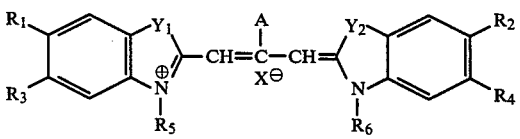

I

-continued

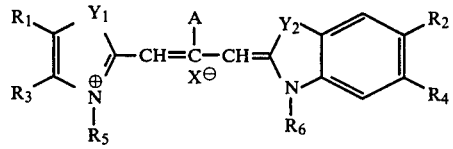

II wherein $Y_1$ and $Y_2$ each represent an O atom, —N—$R_7$ or an S atom, wherein $R_7$ represents a substituted or non-substituted lower alkyl group which may be substituted with a sulfo group, a hydroxy group, a carboxyl group or a halogen atom, A represents a H atom or a lower alkyl group having 4 or less carbon atoms, $R_1$, $R_2$, $R_3$ and $R_4$ each represents —H, —$CH_3$, —$OCH_3$, —$C_2H_5$, —$OC_2H_5$, —CN, —Cl, —F, —$CF_3$, —COOH, —$COOCH_3$ or —$COOC_2H_5$, $R_5$ and $R_6$ each represents a substituted or nonsubstituted lower alkyl group which may be substituted with a sulfo group, a hydroxy group, a carboxyl group or a halogen atom, but at least one of $R_5$ or $R_6$ is substituted with a sulfo goup, and X represents an anionic residue.

DETAILED DESCRIPTION OF THE INVENTION

The effect of the present invention appears to a great degree in the case of rapid development processing where a water washing step after fixing is 30 seconds or less, and, particularly, the effect of the present invention remarkably appears in the case of applying acid hardening fixing using polyvalent metal ions so as to provide a desired drying time suitable for the rapid processing.

The emulsified dispersion (those wherein a water immiscible liquid is dispersed into a water medium in the form of colloidal state) of the water insoluble fluorescent whitening agent used in the present invention can be prepared by, for example, dissolving the water insoluble fluorescent whitening agent in a high boiling point organic solvent or a water insoluble polymer and dispersing the system by emulsification. The latex dispersion (those wherein a water insoluble polymer is dispersed into a water medium in the form of colloidal state) can be prepared by, for example, immersing the water insoluble fluorescent whitening agent in a hydrophobic latex. The dispersion size or latex size is generally about 0.01 to 1$\mu$.

These procedures are illustrated in more detail in the following.

One process for producing a dispersed composition of the water insoluble fluorescent whitening agent used in the present invention is a process which comprises dissolving the fluorescent whitening agent in a high boiling point organic solvent and emulsifying to disperse the same in a hydrophilic colloid such as gelatin, etc., together with one or more surface active agents, as described in British Pat. No. 1,072,915. As the high boiling point organic solvents, phthalic acid esters and phosphoric acid esters as described in U.S. Pat. Nos. 2,322,027, 3,676,137 and 3,779,765, West German Pat. No. 1,152,610, British Pat. No. 1,272,561, Japanese Patent Applications (OPI) No. 1520/78 and 25057/80 (corresponding to U.S. Pat. No. 4,278,757) and Japanese Patent Publication No. 37376/70 (corresponding to U.S. Pat. No. 3,475,172), etc., can be used. However, the solvents are not limited, of course, to them and amide compounds are described in U.S. Pat. No. 3,416,923, benzoic acid esters and substituted paraffins, etc. can be advantageously used. The high boiling point organic solvents used in the present invention preferably have a boiling point of 175° C. or more. The typical examples of the high boiling point organic solovents include a phthalic acid ester (e.g., dibutyl phthalate, dicyclohexyl phthalate, di-2-ethylhexyl phthalate, decyl phthalate), a phosphoric acid ester or phosphonic acid ester (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexyphenyl phosphonate), a benzoic acid ester (e.g., 2-ethylhexyl benzoate, dodecyl benzoate, 2-ethylhexyl-p-hydroxy benzoate), amide compounds (e.g., diethyldodecaneamide, N-tetradecylpyrrolidon), alcohols or phenols (e.g., isostearyl alcohol, 2,4-di-t-amylphenol), an aliphatic carboxylic acid ester (e.g., dioctyl azelate, glycerol tributylate, isostearyl lactate, trioctyl citrate), aniline derivatives (e.g., N,N-dibutyl-2-butoxy-5-t-octylaniline), or hydrocarbons (e.g., paraffin, dodecylbenzene, diisopropylnaphthalene). Further, as an assistant for the organic solvents, an organic solvents having a boiling point of about 30° C. or more, preferably about 50° C. to 160° C. can be used. The typical examples of the low boiling point organic solvents include ethyl acetate, butyl acetate, ethyl propionate, methyl ethyl ketone, cyclohexanone, 2-ethoxyethyl acetate, demethylformamide, etc.

Further, the emulsified dispersion can be produced by the same manner as described above using a water insoluble polymer instead of the above described high boiling point organic solvents.

As the water insoluble polymers, polyurethane and polyacrylic acid esters, etc. can be used.

Other processes for producing a dispersed composition are those which comprise previously dissolving the water insoluble fluorescent whitening agent in a monomer(s) and then polymerizing to prepare a latex dispersion or immersing the whitening agent in a hydrophobic polymer using an auxiliary solvent to prepare a latex dispersion. Such processes are disclosed in, for example, Japanese Patent Application (OPI) No. 126732/75, Japanese Patent Publication No. 47043/76 (corresponding to U.S. Pat. No. 3,513,102), and U.S. Pat. Nos. 3,418,127, 3,359,102, 3,558,316 and 3,788,854, etc.

As the water insoluble fluorescent whitening agent, substituted stilbenes and substituted coumarines as described in British Pat. No. 786,234 and substituted thiophenes as described in U.S. Pat. No. 3,135,762, etc., are useful, and fluorescent whitening agents as described in Japanese Patent Publication No. 37376/70 and Japanese Patent Application (OPI) No. 126732/75 are particularly advantageously used.

Typical useful fluorescent brightening agents (water insoluble fluorescent whitening agents) include those having one of the following structures.

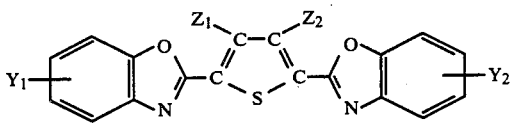

(VII)

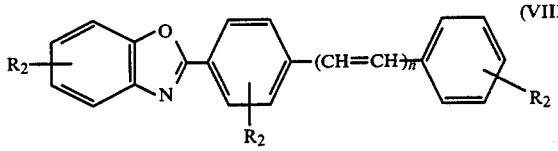

(VIII)

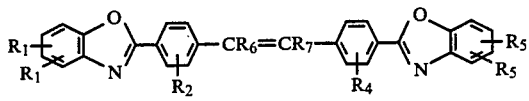

(IX)

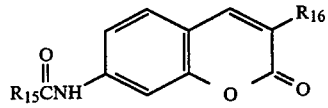

(X)

wherein $Y_1$ and $Y_2$ each represents an alkyl group (preferably $C_1$ to $C_8$), $Z_1$ and $Z_2$ each represents hydrogen or an alkyl group (preferably a lower alkyl group), n is 1 or 2, $R_1$, $R_2$, $R_3$, $R_4$ and $R_5$ each represents an aryl group (preferably $C_1$ to $C_8$), an alkyl group (preferably $C_1$ to $C_8$), an alkoxy group (preferably $C_1$ to $C_8$), an aryloxy group (preferably $C_1$ to $C_8$), a hydroxyl group, an amino group, a cyano group, a carboxyl group, an amide group, an ester group, an alkylcarbonyl group, an alkylsulfo group, a dialkylsulfonyl group or a hydrogen atom, $R_6$ and $R_7$ each represents a hydrogen atom, an alkyl group (preferably $C_1$ to $C_5$), such as a methyl group or an ethyl group, or a cyano group, $R_{16}$ represents a phenyl group, a halogen atom or an alkyl (preferably a lower alkyl group) substituted phenyl group, and $R_{15}$ represents an amino group or an organic primary or secondary amino group, said primary or secondary amino group is preferably substituted with a lower alkyl group.

In the following, examples of water insoluble fluorescent whitening agents used in the present invention are given.

(7)

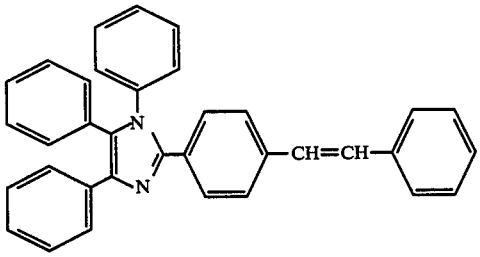

-continued
(8)
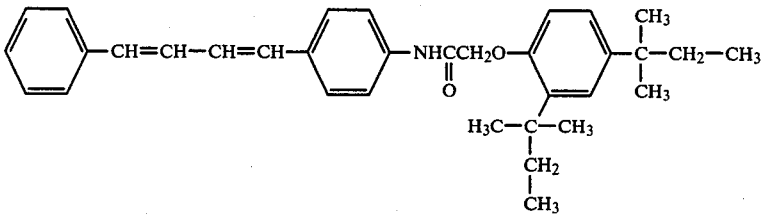
(9)
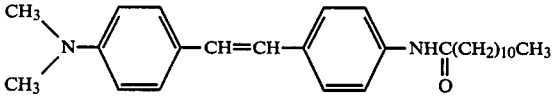
(10)
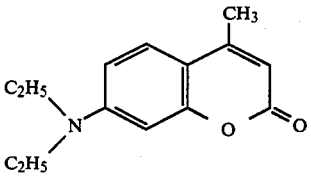
(11)
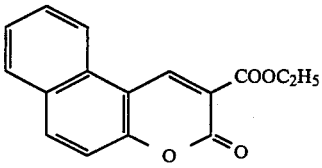
(12)
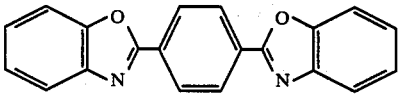
(13)
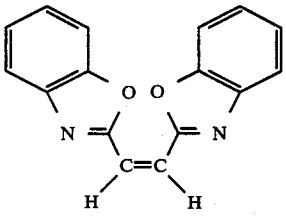
(14)
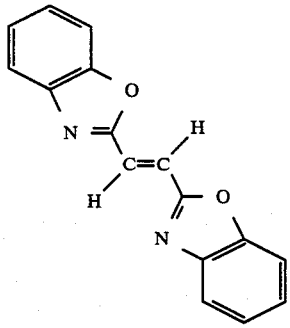
(15)
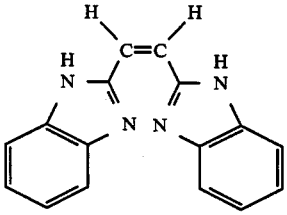

-continued
(16)
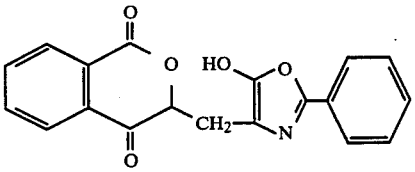
(17)
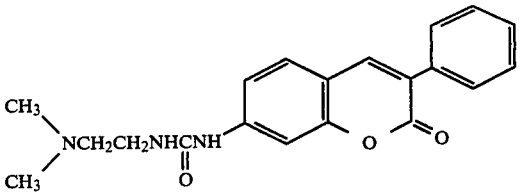
(18)
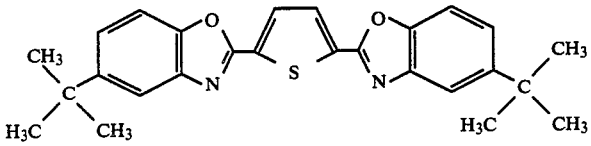
(19)
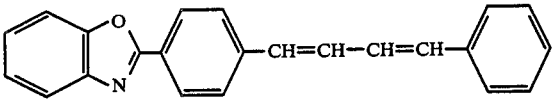
(20)
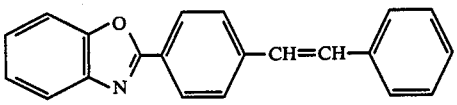
(21)
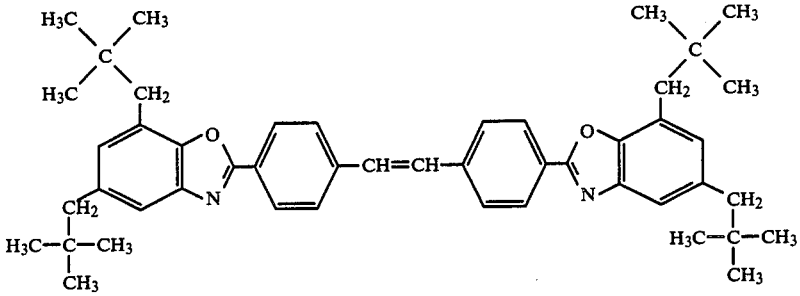
(22)
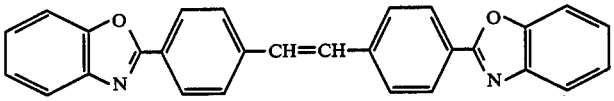
(23)
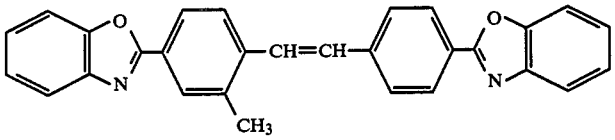
(24)
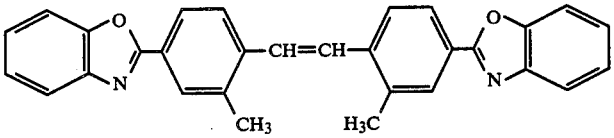
(25)
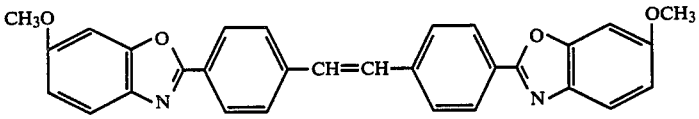

-continued

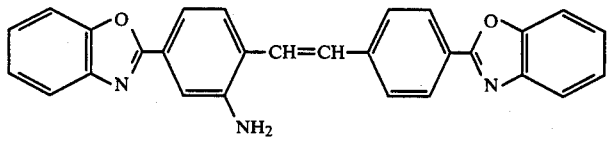

(26)

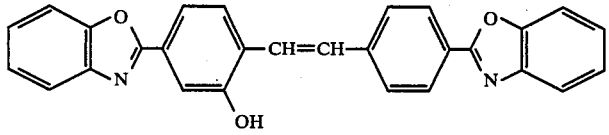

(27)

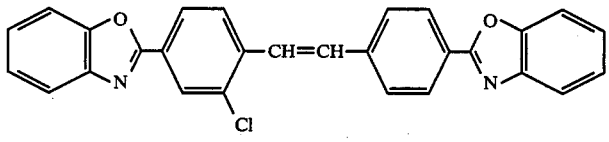

(28)

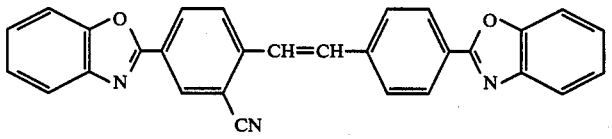

(29)

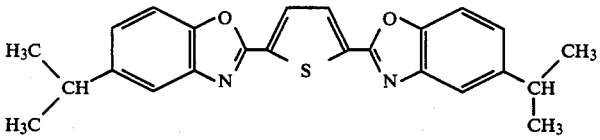

(30)

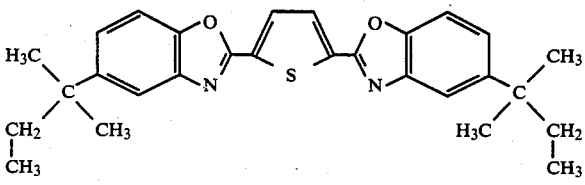

(31)

If the amount of the fluorescent whitening agent is too small, the effect of improving whiteness is not sufficient. If it is too large, blooming is caused in the areas of a high image density to cause a reduction of apparent image density. While the luminescent coefficient of fluorescence cannot be simply determined as it depends upon the kind of fluorescent whitening agent, the kind and concentration of the oil used for emulsification, the presence of various quenching substances or other ultraviolet ray absorbing substances, etc., the fluorescent whitening agent in the present invention is preferably used in a range of 3 mg to 200 mg/m$^2$, more preferably in a range of 10 mg to 50 mg/m$^2$.

The ratio of emulsifying oil or latex as the dispersion medium to the fluorescent whitening agent is selected to be the optimum value from the viewpoint of solubility of the fluorescent whitening agent, concentration and quenching. The ratios of the fluorescent whitening agent to the emulsifying oil and the fluorescent whitening agent to the latex are preferably 1/100 to 1/5, more preferably 1/50 to 1/10, respectively.

The dispersed composition of the fluorescent whitening agent may be added to any layer if the layer is on the same side as the spectrally sensitized silver halide emulsion. However, it is preferable to select an emulsion layer or a layer placed nearer the base than the emulsion layer.

The technique of incorporating the dispersed composition in the hydrophilic vehicle of the silver halide printing paper is a conventional technique, and such a technique is that which has been developed in order to improve the problem that a water soluble fluorescent whitening agent will flow out into the processing bath in development processing over a long period of time, such as a color development bath, to deteriorate the whitening effect.

In rapid development processing which does not substantially cause a deterioration of the fluorescence effect due to agent flowing out into the processing solution even if a water soluble fluorescent whitening agent is used, the phenomenon appears that residual color of a cyanine dye increases in the presence of the water soluble fluorescent whitening agent. In thus rapid processing, it is very difficult to improve the whiteness even if the water soluble fluorescent whitening agent is used. Accordingly, the fact that such a dispersed composition of a water insoluble fluorescent whitening agent can be effectively used as means for improvement of the whiteness is an entirely unexpected matter.

The reason why an increase of such residual color occurs is not clear, but it is believed that a water soluble fluorescent whitening agent interacts with the cyanine dye to change into a form which does not elute from the film in, e.g., a water washing step.

As sensitizing dyes used in the present invention, those wherein $Y_1$ and $Y_2$ in general formulae (I) and (II) each represent N—$R_7$ or an oxygen atom are suitable. In the case that $Y_1$ and $Y_2$ each represent an oxygen atom, it is preferred that $R_1$ represent a hydrogen atom, a methoxy group, an ethoxy group or a methyl group and $R_2$ represent a hydrogen atom, or a methoxy group.

Further, in general formulae (I) and (II), preferred examples of $R_5$ and $R_6$ are alkyl groups having a sulfo group.

In the following, examples of sensitizing dyes used in the present invention are given.

(32)

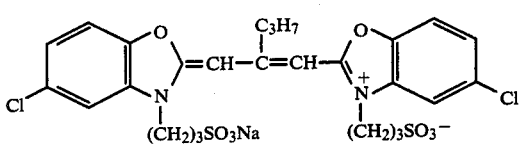

(33)

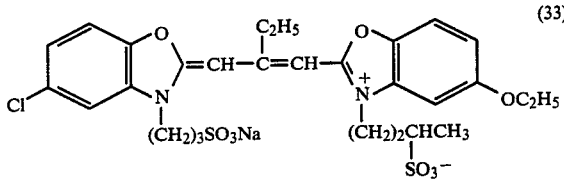

(34)

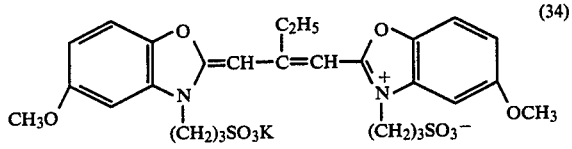

(35)

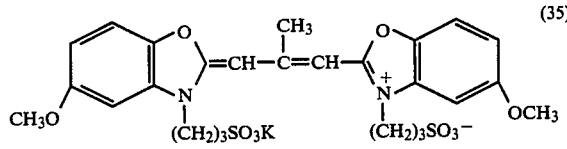

(36)

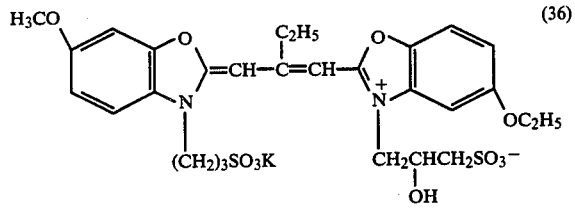

(37)

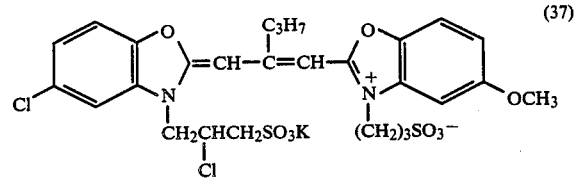

(38)

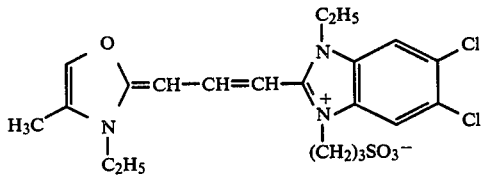

-continued (39)

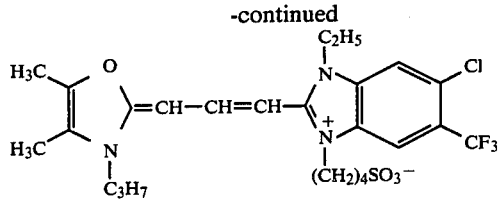

(40)

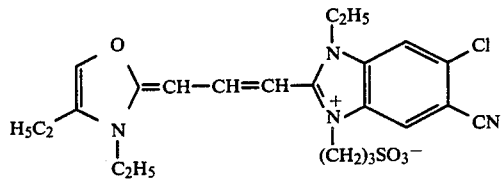

(41)

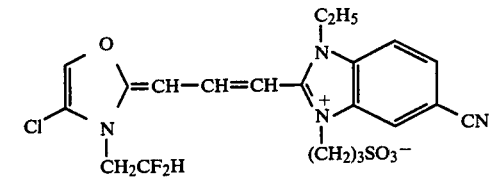

(42)

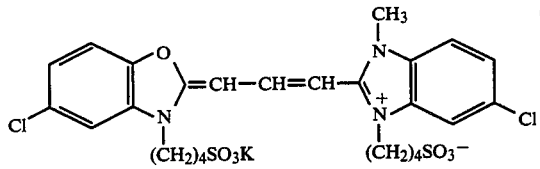

(43)

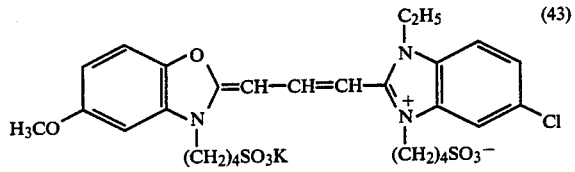

(44)

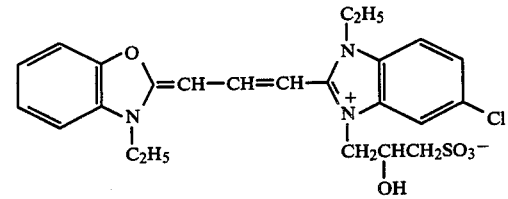

(45)

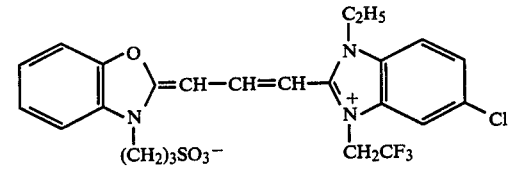

(46)

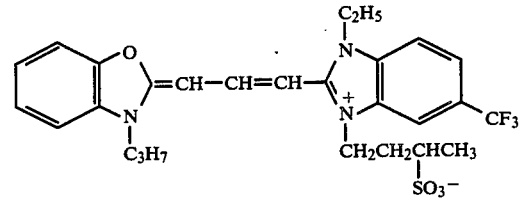

(47)

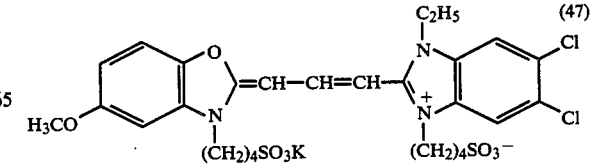

-continued (48)

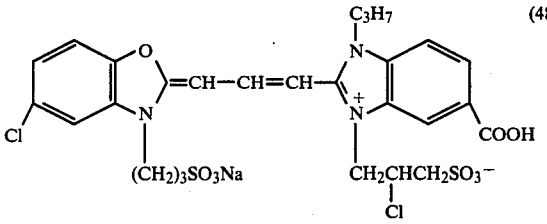

(49)

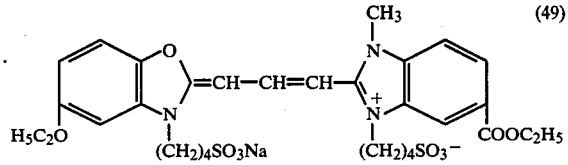

(50)

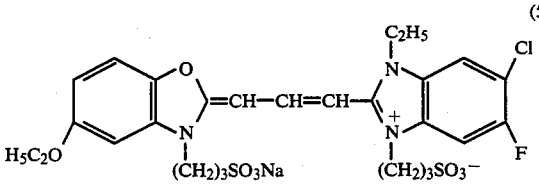

(51)

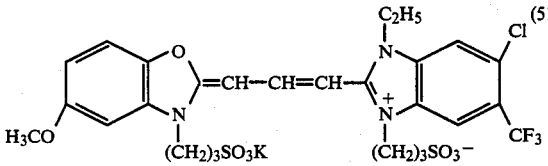

(52)

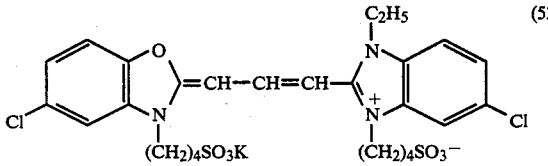

(53)

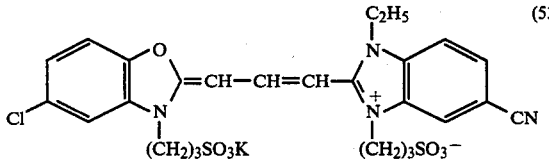

(54)

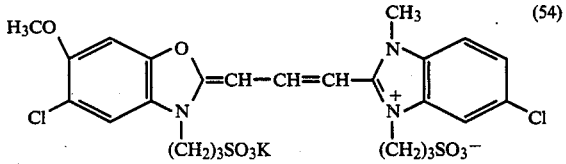

(55)

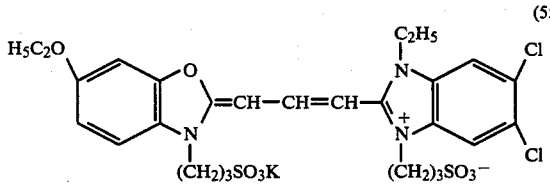

(56)

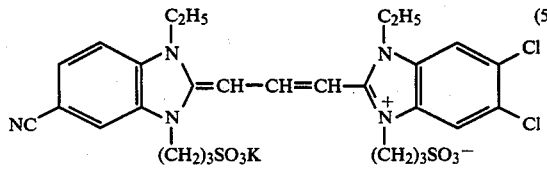

-continued (57)

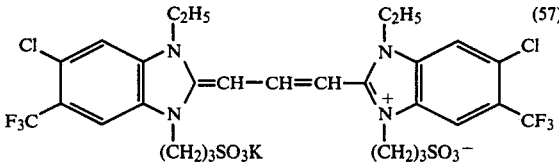

(58)

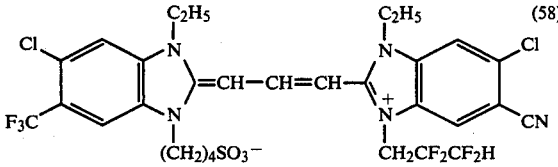

(59)

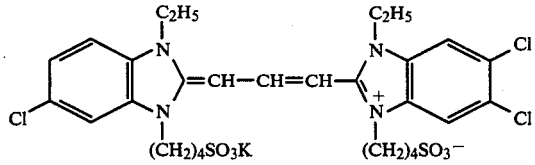

(60)

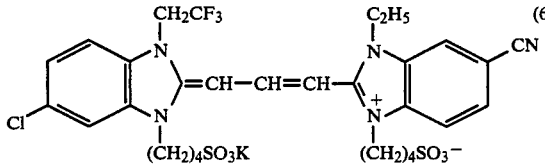

(61)

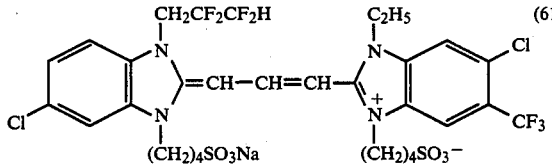

(62)

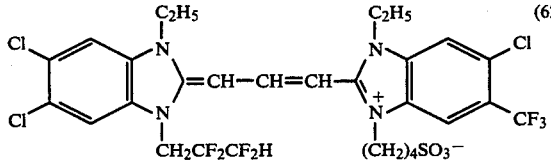

(63)

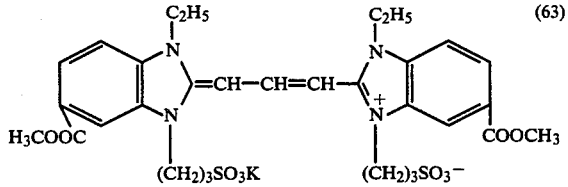

(64)

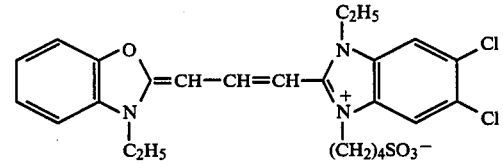

The sensitizing dyes represented by the above described general formulae (I) and (II) used in the present invention are known compounds and can be synthesized with reference to, for example, Japanese Patent Application (OPI) No. 104917/77, Japanese Patent Publication Nos. 22884/68 (corresponding to U.S. Pat. No. 3,397.,060), 25652/73 and 22368/82, F. M. Hamer: The Chemistry of Heterocyclic Compounds, Vol. 18, The Cyanine Dyes and Related Compounds, A. Weissberger ed., Interscience, New York, 1964., D. M. Sturmer; The Chemistry of Heterocyclic Compounds, Vol. 30, A. Weissberger and E. C. Taylor, eds., John Willy, New York, 1977, p. 441., etc.

In order to incorporate the compounds represented by the above described general formula (I) in the silver halide emulsion of the present invention, they may be dispersed directly in the emulsion or may be added to the emulsion after being dissolved in a solvent such as water, methanol, ethanol, propanol, methyl cellosolve, 2,2,3,3-tetrafluoropropanol, etc., or a mixed solvent thereof. They may be added to the emulsion after preparing an aqueous solution using acids or bases as described in Japanese Patent Publication Nos. 23389/69 (corresponding to U.S. Pat. No. 3,482,981), 27555/69 (corresponding to U.S. Pat. No. 3,574,630) and 22089/82 (corresponding to U.S. Pat. No. 4,021,247) or preparing an aqueous solution or a colloid dispersion using surface active agents as described in U.S. Pat. Nos. 3,822,135 and 4,006,025, etc. Further, they may be added to the emulsion by dispersing them in water or a hydrophilic colloid after being dissolved in a solvent which is substantially immiscible with water such as phenoxyethanol, etc. They may be dispersed directly in a hydrophilic colloid and the resultant dispersion added to the emulsion, as described in Japanese Patent Application (OPI) Nos. 102733/78 (corresponding to U.S. Pat. No. 4,140,530) and 105141/83. Addition to the emulsion is generally carried out before application of the emulsion to a suitable base, but it may be carried out during chemical ripening or during formation of silver halide grains (for example, during formation of grains as described in Japanese Patent Application (OPI) No. 26589/80.

The sensitizing dyes represented by general formulae (I) and (II) are typically used in an amount of about $2\times10^{-6}$ to $8\times10^{-3}$ mol per mol of silver halide in the silver halide emulsion. In the case of a silver halide particle size of 0.5 to 1.2 μm, an amount of about $5\times10^{-5}$ to $2\times10^{-3}$ mols is more effective.

Since the object of the present invention is to avoid the peculiar interaction between these dyes and the fluorescent whitening agent, dyes which do not cause such a problem, for example, merocyanine dyes, can be of course be used together with the above described dyes per the present invention.

The photographic emulsions used in the present invention can be prepared by the processes described in P. Glafkides: Chimie et Physique Photographique (Paul Montel, 1967), G. F. Duffin: Photographic Emulsion Chemistry (The Focal Press, 1966) and V. L. Zelikman et al: Making and Coating Photographic Emulsion (The Focal Press, 1964), etc. Namely, any of an acid process, a neutral process or an ammonia process can be used. As the type of reacting soluble silver salts with soluble halogen salts, any of an one side-mixing process (single jet mixing process), a simultaneous mixing process (balanced double jet mixing process) or a combination thereof may be used.

As the silver halide of the emulsions used in the present invention, any of silver bromide, silver chlorobromide, silver iodobromide and silver chloroiodobromide may be used, and any surface latent image type or internal latent image type silver halide may be used. The crystal habit of the silver halide may be not only regular cubic, tetradecahedral or octahedral but may be also plate like in form having a twin plane or a potato-like irregular form (rounded spherical crystal). Plate like crystals having a high aspect ratio where it is necessary to add a large amount of sensitizing dyes because of their high specific surface area are also useful in a printing paper.

The particle size of the silver halide is preferably in the range of 0.2μ to 1.5μ as the average particle size of regular crystals, but the most preferaed range is 0.35μ to 1.0μ.

These silver halide grains may be doped with metals of group VIII in the Periodic Table, such as rhodium, iridium or iron, etc. in order to improve the photographic properties thereof.

The silver halide emulsions are generally chemically sensitized. In order to carry out chemical sensitization, processes as described in, for example, "Die Grundlagender Photographischen Prozesse mit Silverhalogeniden" edited by H. Frieser (Akademische Verlagsgesellschaft, 1968) pages 675 to 734, can be used.

Namely, sulfur sensitization process using sulfur-containing compounds capable of reacting with active gelatin or silver (for example, thiosulfates, thioureas, mercapto compounds and rhodanines), a reduction sensitization process using reducing substances (for example, stannous salts, amines, hydrazine derivatives, formamidine sulfinic acid and silane compounds), and a noble metal sensitization process using noble metal compounds (for example, complex salts of metals of group VIII such as Pt, Ir or Pd, etc., including gold complex salts) can be used alone or in combination.

The amount of silver halide coated should be in a range of not exceeding at most 2 g/m$^2$ as silver, and preferably in a range of not exceeding 1.8 g/m$^2$, from the viewpoint of rapid processing. Further, the total amount of gelatin coated at the emulsion side should be in a range not exceeding 8 g/m$^2$, preferably in a range not exceeding 6 g/m$^2$, because bleaching of dyes in rapid processing is retarded when the amount is too large.

In photographic emulsions used in the present invention, various compounds can be incorporated for the purpose of preventing fog during production of light-sensitive materials, during preservation or during photographic processing or for stabilizing photographic properties. Namely, it is possible to add various compounds known as antifoggants or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly, 1-phenyl-5-mercaptotetrazole), etc.; mercaptopyrimidines; mercaptotriazines; thioketo compounds such as oxazolinethione; azaindenes, for example, triazaindenes, tetrazaindenes (particularly, 4-hydroxy substituted (1,3,3a,7)tetrazaindenes) and pentazaindenes, etc.; benzenethiosulfonic acids, benzenesulfinic acids, and benzenesulfonamides, etc.

In the silver halide emulsions used in the present invention, tetrazaindenes, mercaptoazoles, substituted benzotriazoles and thiosulfonic acids are particularly suitably used.

It is particularly useful to use a mercapto compound in an amount which does not substantially prevent adsorption of cyanine dyes to prevent development fog which is easily caused in rapid processing at a high temperature. Further, it is possible to incorporate black-and-white developing agents or precursors thereof, such as hydroquinones, 3-pyrazolidones or aminophenols, etc., and antioxidants such as sulfates, etc., in the light-sensitive materials for the purpose of increasing suitability for rapid processing.

In the present invention, various light-absorbing substances other than sensitizing dyes can be used for the purpose of improving photographic characteristics. For such a purpose, filter dyes, antihalation dyes and antiirradiation dyes are commonly used. In addition, it can be advantgeous to incorporate ultraviolet ray absorbing dyes which reduce the action of the fluorescent whitening agent, whereby bad effects due to unnecessary fluorescence caused in the present invention (for example, increase of static marks, etc.) is prevented. Further, it is advantageous to use a bluing agent for the purpose of improving apparent whiteness.

In the present invention, fogging agents, desensitizing dyes, and development accelerators such as amines, etc., may also be incorporated for the purpose of controlling photographic characteristics.

Further, in the present invention, for the purpose of promoting decoloration of sensitizing dyes, gelatin as a binder can be modified to form gelatin derivatives, or cellulose derivatives such as carboxymethyl cellulose or hydroxyethyl cellulose, etc., or hydrophilic polymers such as polyvinyl alcohol or polyvinyl pyrrolidone, etc., can be blended with gelatin.

The pH of the gelatin film is generally adjusted to the range of 5 to 7. For example, in the case of incorporating a developing agent, it is adjusted to a low value, and in case of using an edditive which relates to adsorption in silver halide, it can be adjusted to a high value or a low value depending on the additive.

As the base used in the present invention, a water impermeable, reflective base is used. In case of printing paper using, for example, baryta paper which requires water washing for a long time, the effect of the present invention is more difficult to achieve because the residual color of the cyanine dyes is substantially removed by water washing for a long time. Typical examples of the water impermeable reflective bases are polyolefin-laminated paper bases polyethylene terephthalate bases changed to opaque state with a white pigment. Particularly those which contain a white pigment in the polyolefin-laminated layer at the image side are most generally used, but film bases in which a white pigment is incorporated to increase reflectivity can also be used.

As the hydrophilic vehicles used in emulsion layers, a protective layer, an antihalation layer, etc., gelatin is most generally used, but various hydrophilic polymers can be added to the gelatin. It is particularly advantageous to incorporate anionic polymers in order to control the properties of a gelatin solution at the time of applying it. Further, in order to improve the properties of gelatin film so as to adapt the same to rapid processing, various hydrophobic polymer latexes such as polyethylarcylate, etc. can be incorporated, and they can be used together with a fluorescent whitening agent impregnating latex according to the desired effect. In order to incorporate water insoluble additives other than fluorescent whitening agents, other oil dispersing emulsifiers can be used if necessary.

In order to harden gelatin, hardeners such as formalin type agents, chlorotriazine type agents, vinyl-sulfonic acid type agents or mucochloric acid, etc., can be used, and it is suitable to control the film strength and the degree of swelling so as to adapt the same to rapid processing.

As surface active agents used as coating aids, there are various kinds of anionic, nonionic and ampholytic surface active agents, and alkylbenzenesulfonic acid salts, N-methyl-N-oleyltaurine salts and analogues thereof, alkyl-phenoxy-polyoxyethylenealkylsulfonic acid salts and alkyl-betaine salts having a substituted alkyl group, etc., are particularly advantageously used. Further, in order to control the amount of electrification or changing, polyethylene oxide type nonionic surface active agents or fluorine substituted surface active agents can be used together therewith. In order to prevent deterioration of film properties caused by the addition of emulsified substances, it is advantageous to use means for improving surface characteristics, such as matting agents or lubricants, etc. In order to prevent curling in the case of using a thin base or to prevent the formation of static marks, a back layer composed of gelatin or another polymer(s) can be provided. The back layer may contain antistatic agents and surface active agents, etc. Further, in order to prevent adhesion in the case of storing light-sensitive materials in piles, colloidal silica, inorganic or organic matting agents or additives giving a water-repelling property, etc., may be added. in order to prevent substantial migration of substances between a backing layer and emulsion layer. The same additives as those containing in the emulsion layer can be previously added to the backing layer.

Photographic processing of the light-sensitive materials of the present invention can be carried out by any known processes as described in, for example *Research Disclosure,* No. 176, pages 28–30 (RD-17643). As processing solutions, those which are conventionally used can be used. The processing temperature is generally selected from a range of 18° C. to 50° C., but a temperature lower than 18° C. and a temperature higher than 50° C. may be used. Any development processing forming silver images (black-and-white photographic processing) and color photographic processing comprising development processing to form dye images can be adopted as the occasion demands.

The developing solution used in the case of carrying out black-and-white photographic processing can contain known develping agents. As the developing agents, dihydroxy-benzenes (for example, hydroquinone), 3-pyrazolidones (for example, 1-phenyl-3-pyrazolidone), aminophenols (for example, N-methyl-p-aminophenol), 1-phenyl-3-pyrazolines, ascorbic acid, and heterocyclic compounds where a 1,2,3,4-tetrahydroquinoline ring and an indolenine ring are fused as described in U.S. Pat. No. 4,067,872, etc., can be used alone or in combination. The developing solution generally contains known preservatives, alkali agents, pH buffers and antifoggants, etc., in addition to thereto. If necessary, it may contain dissolution assistants, toning agents, development accelerators, surfactants, defoaming agents, water softeners, hardeners, viscosity imparting agents, etc. After the black-and-white development, the fixing and water washing are preferably carried out.

As a fixing solution, one having a composition conventionally used can be used.

As fixing agents, thiosulfates and thiocyanates as well organic sulfur compounds which are known to have an effect as fixing agents can be used.

The fixing solution may contain water soluble aluminum salts, potassium alum, chromium alum, etc., as hardeners.

The light-sensitive materials of the present invention are preferably processed with an automatic developing apparatus, whereby it becomes possible to carry out rapid processing. In this case, it is preferred to carry out development at 30° to 45° C. for 5 to 60 seconds, fixing at 30° to 45° C. for 5 to 30 seconds and water washing at 30° to 45° C. for 5 to 30 seconds. Further, in this case, it is preferred to use an acid hardening fixing bath containing polyvalent metal such as aluminum as the fixing bath. Where aluminum is used as a polyvalent metal, its amount is preferably 0.1 to 10 g/l-Fixer, more preferably 0.5 to 2 g/l-Fixer. In the rapid processing, the processing time from dry to dry can be shorten to about 2 minutes or less.

EXAMPLE 1

To an emulsion containing monodispersed silver iodobromide grains (cubic crystal having rounded corners, containing 1.0 mol % iodine) having an average size of 0.6μ prepared by a double jet process, 0.30 millimols/mol-AgX of a cyanine sensitizing dye selected from general formula I were added as shown in Table 1, and various fluorescent whitening agents were added to prepare coating solutions as shown in Table 1.

After gelatin concentration was controlled so as to provide 2.6 g of silver and 4.5 g of gelatin in 100 g of the coating solution, 1 mg of 1-phenyl-5-mercaptotetrazole was added as an antifoggant and 0.2 g of 2,4-dichloro-6-hydroxy-1,3,5-triazine was added as a hardener. The coating solution was applied to a polyethylene laminated paper (the surface laminate layer contained 15 wt % of titanium white) having a thickness of 110μ together with a protective layer thereover composed of 1.5 g/m$^2$ of gelatin to produce a coated product having a silver content of 1.3 g/m$^2$. In the protective layer coating solution, Triton X-200 (Rohm & Haas Co.) was added in an amount to provide 30 mg/m$^2$ in the protective layer as a coating aid. In some samples, the fluorescent whitening agent was added to the protective layer instead of the emulsion layer, or polyvinyl pyrrolidone having an average molecular weight of about 100,000 was added to the protective layer to prevent migration of the water soluble fluorescent whitening agent. This information is given in Table 1.

Samples prepared by adding various kinds of sensitizing dyes and fluorescent whitening agents are shown in Table 1. The fluorescent whitening agent dispersion in Samples 8, 9, 20, 21, 25, 26, 30 and 31 was prepared as shown in Table 3. After each sample was subjected to wedge exposure using a tungsten light source of 2854° K., development processing was carried out under the conditions shown in Table 2, and the sensitometric sensitivity, whiteness and absorption intensity of residual color of the sensitizing agent and fluorescence intensity in non-exposed areas were measured. Whiteness was measured using an Elrefo Whiteness meter made by Karl-Zeiss Co. using a xenon lamp without a filter. Absorption intensity of residual color was measured using a color analyzer Type-607 made by Hitachi Ltd. using a halogen light source and was represented as absorbance. Fluorescence intensity was measured by a fluophotometer. Type 850 made by Hitachi Ltd. using a xenon light source. The wavelength of the excitation light was 380 nm for fluorescent whitening agents 1 to 6 and 400 nm for agent 18, which had a band width of 5 nm. The measurement was carried out at a band width of 5 nm, and the results are indicated as values of the wavelength of the luminescent peak for each fluorescent whitening agent.

The results obtained under a processing condition (B) including acid hardening fixing are shown in Table 4, and the results obtained under a processing condition (A) involving nonhardening fixing are shown in Table 5. Processing conditions (A) and (B) are explained in Table 3.

As can be understood from these results, the increase in sensitivity expected from the cyanine dyes and the increase in whiteness expected from the water soluble fluorescent whitening agents were not realized because of an increase in unexpected residual color due to the sensitizing dyes when both of them were used together (Samples 11 to 17, 23, 24, 28 and 29).

In sample (18) where the fluorescent whitening agent was added to the protective layer and fixed with polyvinyl pyrrolidone in the protective layer to avoid contact of the fluorescent whitening agent with the sensitizing dye, some improvement was observed but it was not satisfactory. In destinctions, in the case of using the oil soluble fluorescent whitening agent (exemplified compound 18) as an oil dispersion or latex dispersion (samples 20, 21, 25, 26, 30 and 31), such disadvantage was not encountered and finished goods were obtained in high sensitivity.

Further, it can be understood from a comparison of the results shown in Table 4 and Table 5 that residual color due to cyanine dyes generally tends to increase upon processing using an acid hardening fixing bath, and the effect of the present invention under such a condition is remarkably excellent as compared with the comparative examples using water soluble fluorescent whitening agents.

TABLE 1

| Sample No. | Sensitizing Dye | Fluorescent Whitening Agent | | | | Note |
|---|---|---|---|---|---|---|
| | | Compound | Amount Added | Layer Added | Method of Addition | |
| 1 | None | | None | | | |
| 2 | " | Compound 1 | 55 mg/m$^2$ | Emulsion layer | Added as aqueous solution | |
| 3 | " | Compound 2 | " | Emulsion layer | Added as aqueous solution | |
| 4 | " | Compound 3 | " | Emulsion layer | Added as aqueous solution | |
| 5 | " | Compound 4 | " | Emulsion layer | Added as aqueous solution | |
| 6 | " | Compound 5 | " | Emulsion layer | Added as aqueous solution | |
| 7 | " | Compound 6 | " | Emulsion layer | Added as aqueous solution | |
| 8 | " | Compound 18 | 20 mg/m$^2$ | Emulsion layer | Added as oil dispersion | |
| 9 | " | Compound 18 | " | Emulsion layer | Added as latex dispersion | |

TABLE 1-continued

| Sample No. | Sensitizing Dye | Fluorescent Whitening Agent Compound | Amount Added | Layer Added | Method of Addition | Note |
|---|---|---|---|---|---|---|
| 10 | Compound 64 | | None | | | |
| 11 | " | Compound 1 | 55 mg/m$^2$ | Emulsion layer | Added as aqueous solution | |
| 12 | " | Compound 2 | " | Emulsion layer | Added as aqueous solution | |
| 13 | " | Compound 3 | 55 mg/m$^2$ | Emulsion layer | Added as aqueous solution | |
| 14 | " | Compound 4 | " | Emulsion layer | Added as aqueous solution | |
| 15 | " | Compound 5 | " | Emulsion layer | Added as aqueous solution | |
| 16 | " | Compound 6 | " | Emulsion layer | Added as aqueous solution | |
| 17 | " | Compound 1 | " | Protec-tive layer | Added as aqueous solution | |
| 18 | " | Compound 1 | " | Protec-tive layer | Added together with polyvinyl pyrroli-done 150 mg (average molecular weight) | |
| 19 | " | Compound 18 | 20 mg/m$^2$ | Emulsion layer | Added by dissolving in mixed solvent of acetone/ethyl acetate | |
| 20 | " | " | " | Emulsion layer | Added as oil dispersion | This invention |
| 21 | " | " | " | Emulsion layer | Added as latex dispersion | This invention |
| 22 | Compound 35 | | None | | | |
| 23 | " | Compound 1 | 55 mg/m$^2$ | Emulsion layer | Added as aqueous solution | |
| 24 | " | Compound 3 | " | Emulsion layer | Added as aqueous solution | |
| 25 | " | Compound 18 | 20 mg/m$^2$ | Emulsion layer | Added as oil dispersion | This invention |
| 26 | " | " | " | Emulsion | Added as latex dispersion | This invention |
| 27 | Compound 47 | | None | | | |
| 28 | " | Compound 1 | 55 mg/m$^2$ | Emulsion layer | Added as aqueous solution | |
| 29 | " | Compound 3 | " | Emulsion layer | Added as aqueous solution | |
| 30 | " | Compound 18 | 20 mg/m$^2$ | Emulsion layer | Added as oil dispersion | This invention |
| 31 | " | " | " | Emulsion layer | Added as latex dispersion | This invention |

TABLE 2

| | |
|---|---|
| Composition of Developing Solution | |
| 1-Phenyl-3-pyrazolidone | 0.4 g |
| Sodium sulfite (anhydrous) | 67 g |
| Hydroquinone | 23 g |
| Potassium hydroxide | 11 g |
| Sodium carbonate monohydrate | 11 g |
| Potassium bromide | 3 g |
| 5-Methyl-benzotriazole | 133 mg |
| Water | to make 1 l |
| Composition of Fixing Solution (A) | |
| Ammonium thiosulfate | 170 g |
| Sodium sulfite (anhydrous) | 15 g |
| Boric acid | 7 g |
| Glacial acetic acid | 5 g |
| Ethylenediaminetetraacetic acid | 0.1 g |
| Water | to make 1 l |
| Composition of Fixing Solution (B) | |
| The following substances are added to the above described composition (A): | |
| Tartaric acid | 3.5 g |
| Glacial acetic acid | 10 g |
| Potassium alum | 20 g |
| Processing Conditions | |
| Development processing was carried out using a small-sized automatic developing apparatus using the above described processing solutions under the following conditions: | |
| Development 35° C. | 18 seconds |

TABLE 2-continued

| | | |
|---|---|---|
| Fixing | 35° C. | 15 seconds |
| Water wash | 15° C. | 15 seconds. |

Condition (A) was the case using the fixing solution (A), and Condition (B) was the case of using fixing soluton (B).

TABLE 3

Example of Preparation of Oil Dispersion Fluorescent Whitening Composition 0.4 g of a fluorescent whitening agent was dissolved with heating at 70° C. in 10 g of di-n-octyl phthalate and 10 ml of ethyl acetate as dispersion oils. After the solution was blended with 80 ml of a 6% aqueous solution of gelatin containing 0.7 g of sodium dodecylbenzenesulfonate, it was finely dispersed by stirring at a high rate for 5 minutes using a homogenizer to obtain an emulsified dispersion composition.

Example of Preparation of Latex Dispersion Fluorescent Whitening Composition 0.4 g of a fluorescent whitening agent was dissolved in 20 g of ethyl acrylate. After 7.5 g of sodium p-nonylphenoxy-polyoxyethylene butanesulfonate was added thereto, it was blended with 80 ml of water with stirring. After the mixture was heated to 60° C., 2 g of sodium persulfate and 0.7 g of sodium hydrogen sulfite were added and polymerization was conducted for 4 hours at 60° C. After colling, it was filtered with muslin to obtain a latex dispersion.

TABLE 4

| Sample No. | Relative Sensitivity (Value of log E) (CMS) | Relative Fluorescence Intensity (Peak value) Before Processing | After Processing | Intensity Presidual Color (Peak value of absorbance | Whiteness (%) |
|---|---|---|---|---|---|
| 1 | 0 | 0 | 0 | 0 | 87.0 |
| 2 | −0.04 | 320 | 500 | 0 | 91.7 |
| 3 | −0.05 | 310 | 390 | 0 | 90.3 |
| 4 | −0.03 | 290 | 430 | 0 | 91.1 |
| 5 | −0.04 | 270 | 450 | 0 | 91.3 |
| 6 | −0.05 | 320 | 510 | 0 | 91.8 |
| 7 | −0.03 | 300 | 490 | 0 | 91.7 |
| 8 | −0.03 | 400 | 630 | 0 | 93.0 |
| 9 | −0.04 | 340 | 560 | 0 | 92.5 |
| 10 | +0.67 | 0 | 0 | 0.042 | 82.1 |
| 11 | +0.62 | 310 | 490 | 0.105 | 78.8 |
| 12 | +0.62 | 300 | 400 | 0.085 | 80.3 |
| 13 | +0.64 | 300 | 420 | 0.087 | 80.4 |
| 14 | +0.61 | 260 | 430 | 0.092 | 79.7 |
| 15 | +0.63 | 320 | 500 | 0.104 | 78.8 |
| 16 | +0.63 | 300 | 480 | 0.101 | 78.6 |
| 17 | +0.62 | 520 | 580 | 0.100 | 80.0 |
| 18 | +0.60 | 450 | 730 | 0.069 | 84.5 |
| 19 | +0.62 | 70 | 120 | 0.040 | 82.4 |
| 20 | +0.63 | 390 | 620 | 0.047 | 88.4 |
| 21 | +0.64 | 340 | 570 | 0.048 | 88.3 |
| 22 | +0.62 | 0 | 0 | 0.030 | 85.3 |
| 23 | +0.08 | 310 | 520 | 0.095 | 83.9 |
| 24 | +0.36 | 270 | 400 | 0.072 | 84.5 |
| 25 | +0.59 | 410 | 630 | 0.035 | 91.5 |
| 26 | +0.58 | 350 | 580 | 0.034 | 91.0 |
| 27 | +0.61 | 0 | 0 | 0.028 | 84.8 |
| 28 | +0.17 | 330 | 520 | 0.083 | 80.5 |
| 29 | +0.40 | 290 | 430 | 0.065 | 82.2 |
| 30 | +0.58 | 400 | 640 | 0.030 | 89.1 |
| 31 | +0.58 | 350 | 580 | 0.031 | 88.8 |

TABLE 5

| Sample No. | Relative Fluorescence Intensity (Peak value after processing) | Intensity of Residual Color (Peak value of absorbance) | Whiteness (%) |
|---|---|---|---|
| 1 | 0 | 0 | 87.2 |
| 2 | 490 | 0 | 91.9 |
| 4 | 410 | 0 | 90.8 |
| 8 | 630 | 0 | 93.1 |
| 9 | 570 | 0 | 92.6 |
| 10 | 0 | 0.021 | 85.3 |
| 11 | 500 | 0.043 | 84.0 |
| 13 | 400 | 0.033 | 84.2 |

TABLE 5-continued

| Sample No. | Relative Fluorescence Intensity (Peak value after processing) | Intensity of Residual Color (Peak value of absorbance) | Whiteness (%) |
|---|---|---|---|
| 20 | 620 | 0.022 | 91.1 |
| 21 | 580 | 0.023 | 90.4 |
| 22 | 0 | 0.018 | 86.0 |
| 23 | 510 | 0.034 | 87.3 |
| 24 | 390 | 0.025 | 87.7 |
| 25 | 610 | 0.018 | 92.4 |
| 26 | 570 | 0.019 | 91.8 |
| 27 | 0 | 0.015 | 85.9 |
| 28 | 510 | 0.030 | 86.3 |
| 29 | 400 | 0.022 | 87.0 |
| 30 | 640 | 0.017 | 91.5 |
| 31 | 570 | 0.016 | 91.0 |

EXAMPLE 2

For comparison, samples using the following dyes in the same manner as in Example 1 were produced further information being shown in Table 6.

(65)

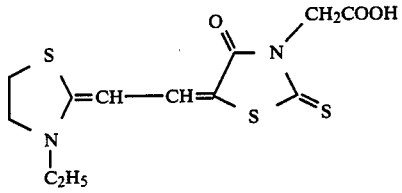

(66)

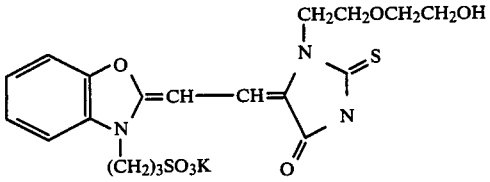

(67)

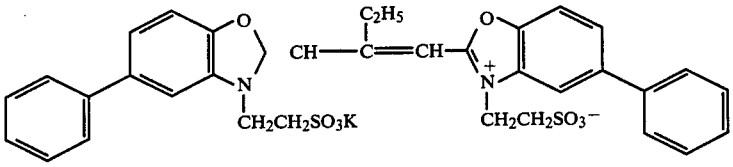

The results obtained under processing condition (B) are shown in Table 7.

As will be obvious from these results, increased residual color of dyes due to the water soluble fluorescent whitening agent was not observed in Samples 35 and 36 using merocyanine dyes. However, high sensitivity as in the case of using cyanine dyes was not obtained with these dyes. It can be understood that dyes beyond the scope of the present invention (Dye 67), even though they are cyanine dyes, cause remarkable residual color, and the object of the present invention is not attained if such is combined with the fluorescent whitening agent dispersed in oil.

TABLE 6

| Sample No. | Sensitizing Dye | Fluorescent Whitening Agent: Compound | Amount Added | Layer Added | Method of Addition |
|---|---|---|---|---|---|
| 32 | Compound 65 | | None | | |
| 33 | Compound 66 | | " | | |
| 34 | Compound 67 | | " | | |
| 35 | Compound 65 | Compound 1 | 55 mg/m$^2$ | Emulsion layer | Added as aqueous solution |
| 36 | Compound 66 | Compound 1 | " | Emulsion layer | Added as aqueous solution |
| 37 | Compound 67 | Compound 1 | " | Emulsion layer | Added as aqueous solution |

TABLE 6-continued

| Sample No. | Sensitizing Dye | Fluorescent Whitening Agent: Compound | Amount Added | Layer Added | Method of Addition |
|---|---|---|---|---|---|
| 38 | Compound 65 | Compound 18 | 20 mg/m$^2$ | Emulsion layer | Added as oil dispersion |
| 39 | Compound 66 | Compound 18 | " | Emulsion layer | Added as oil dispersion |
| 40 | Compound 67 | Compound 18 | " | Emulsion layer | Added as oil dispersion |

TABLE 7

| Sample No. | Relative Sensitivity (Value of log E) (CMS) | Relative Fluorescence Intensity (Peak value after processing | Intensity of Residual Color (Peak value of absorbance | Whiteness (%) |
|---|---|---|---|---|
| 32 | +0.40 | 0 | 0.021 | 86.2 |
| 33 | +0.52 | 0 | 0.042 | 83.8 |
| 34 | +0.68 | 0 | 0.263 | 70.3 |
| 35 | +0.37 | 480 | 0.020 | 88.3 |
| 36 | +0.48 | 460 | 0.043 | 85.7 |
| 37 | +0.64 | 450 | 0.301 | 69.8 |
| 38 | +0.37 | 630 | 0.021 | 91.5 |
| 39 | +0.48 | 620 | 0.040 | 89.5 |
| 40 | +0.65 | 610 | 0.270 | 72.3 |

EXAMPLE 3

Dispersed compositions of fluorescent whitening agent were produced by the process shown in Table 3 of Example 1 while varying the fluorescent whitening agent and the oil as explained in Table 8, and coated products having the following composition were produced in the same manner as in Example 1. They were subjected to development processing under processing condition (B) and the whiteness thereof was measured.

TABLE 8

| Sample No. | Sensitizing Dye | Composition: Fluorescent Whitening Agent | Fluorescent Whitening Agent Added | Dispersing Oil | Whiteness After Processing (%) |
|---|---|---|---|---|---|
| 41 | Compound 38 | — | None | — | 85.5 |
| 42 | Compound 38 | Compound 10 | 20 mg/m$^2$ | Di-n-octyl-phthalate | 90.2 |
| 43 | Compound 38 | Compound 22 | " | Di-n-octyl-phthalate | 91.3 |
| 44 | Compound 38 | Compound 17 | " | Di-n-octyl-phthalate | 89.7 |
| 45 | Compound 38 | Compound 18 | " | Tricresyl phosphate | 92.0 |
| 46 | Compound 38 | Compound 18 | " | Diethyl-lauric acid amide | 91.7 |

It can be seen that all of Sample Nos. 42 to 46 show excellent whiteness.

While the invention has been described in detail and with reference to specific embodiments thereof, it will be apparent to one skilled in the art that various changes and modifidations can be made therein without departing from the spirit and scope thereof.

What is claimed is:

1. In silver halide photographic printing paper comprising at least one silver halide photographic emulsion layer applied to a water impermeable reflective base, the improvement wherein said silver halide emulsion layer is spectrally sensitized with at least one cyanine dye represented by general formulae I and II, and an emulsified dispersion or latex dispersion of a water insoluble fluorescent whitening agent contained in a hydrophilic vehicle of at least one layer applied to the base on the same side as said silver halide emulsion layer:

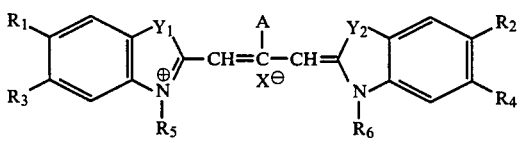

I

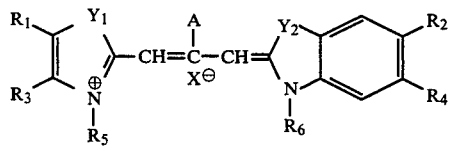

II wherein $Y_1$ and $Y_2$ each represents an O atom, —N—$R_7$ or a S atom, wherein $R_7$ represents a lower alkyl group, A represents H or a lower alkyl group having 4 or less carbon atoms, $R_1$, $R_2$, $R_3$ and $R_4$ each represents —H, —$CH_3$, —$OCH_3$, —$CH_2H_5$, —$OC_2H_5$, —CN, —Cl, —F, —$CF_3$, —COOH, —$COOCH_3$ or —$COOC_2H_5$, $R_5$ and $R_6$ each represents a substituted or non-substituted lower alkyl group, but at least one of $R_5$ and $R_6$ is substituted by a sulfo group, and X represents an anionic residue, and wherein the water insoluble fluorescent whitening agent is selected from the compounds represented by the following formulae:

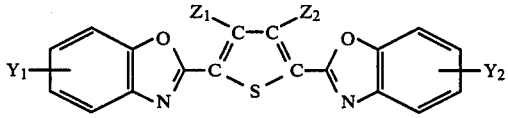

(VII)

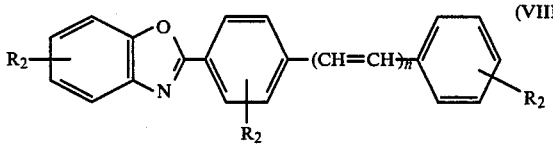

(VIII)

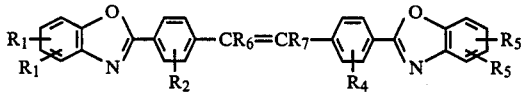

(IX)

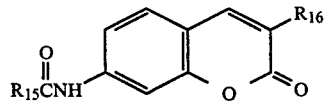

(X)

wherein $Y_1$ and $Y_2$ each represents an alkyl group, $Z_1$ and $Z_2$ each represents hydrogen or an alkyl group, n is 1 or 2, $R_1$, $R_2$, $R_3$, $R_4$ and $R_5$ each represents an aryl group, an alkyl group, an alkoxy group, an aryloxy group, a hydroxyl group, an amino group, a cyano group, a carboxyl group, an amide group, an ester group, an alkylcarbonyl group, an alkylsulfo group, a dialkylsulfonyl group or a hydrogen atom, $R_6$ and $R_7$ each represents a hydrogen atom, an alkyl group, or a cyano group, $R_{16}$ represents a phenyl group, a halogen atom or an alkyl substituted phenyl group, a halogen atom or an alkyl substituted phenyl group, and $R_{15}$ represents an amino group or an organic primary or secondary amino group.

2. The silver halide photographic printing paper according to claim 1, wherein the whiteness of the printing paper after development processing is 87% or more.

3. The silver halide photographic printing paper according to claim 1, wherein the water insoluble fluorescent whitening agent is used in a range of 3 to 200 $mg/m^2$.

4. The silver halide photographic printing paper according to claim 1, wherein $Y_1$ and $Y_2$ in general formulae I and II each represents N—$R_7$ or an oxygen atom.

5. The silver halide photographic printing paper according to claim 4, wherein $Y_1$ and $Y_2$ each represents an oxygen atom, $R_1$ represents a hydrogen atom, a methoxy group, or a methyl group and $R_2$ represents a hydrogen atom or a methoxy group.

6. The silver halide photographic printing paper according to claim 1, wherein $R_5$ and $R_6$ in general formulae I and II each represents alkyl groups having a sulfo group.

7. The silver halide photographic printing paper according to claim 1, wherein the sensitizing dyes represented by general formulae I and II are used in an amount of about $2\times10^{-6}$ to $8\times10^{-3}$ mol per mol of silver halide in the silver halide emulsion.

8. The silver halide photographic printing paper according to claim 1, wherein the amount of silver halide coated is in a range of not exceeding at most 2 $g/m^2$ as silver.

9. The silver halide photographic printing paper according to claim 1, wherein the total amount of gelatin coated at the emulsion side is in a range not exceeding 8 $g/m^2$.

10. The silver halide photographic printing paper according to claim 1, wherein the ratio of the fluorescent whitening agent to the emulsifying oil is 1/100 to 1/5.

11. The silver halide photographic printing paper according to claim 1, wherein the ratio of the fluorescent whitening agent to the latex is 1/100 to 1/5.

12. A method of black-and-white development processing comprising processing, with a black and white developer, a silver halide photographic printing paper comprising at least one silver halide photographic emulsion layer applied to a water impermeable reflective base, wherein said silver halide emulsion layer is spectrally sensitized with at least one cyanine dye represented by general formulae I and II, and an emulsified dispersion or latex dispersion of a water insoluble fluorescent whitening agent contained in a hydrophilic vehicle of at least one layer applied to the base on the same side as said silver halide emulsion layer:

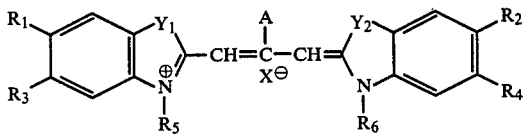

I

-continued

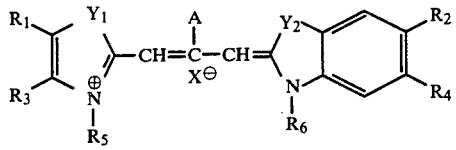

II wherein $Y_1$ and $Y_2$ each represents an O atom, —N—$R_7$ or a S atom, wherein $R_7$ represents a lower alkyl group, A represents H or a lower alkyl group having 4 or less carbon atoms, $R_1$, $R_2$, $R_3$ and $R_4$ each represents —H, —$CH_3$, —$OCH_3$, —$C_2H_5$, —$OC_2H_5$, —CN, —Cl, —F, —$CF_3$, —COOH, —$COOCH_3$ or —$COOC_2H_5$, $R_5$ and $R_6$ each represents a substituted or non-substituted lower alkyl group, but at least one of $R_5$ and $R_6$ is substituted by a sulfo group, and X represents an anionic residue, and wherein the water insoluble fluorescent whitening agent is selected from the compounds represented by the following formulae:

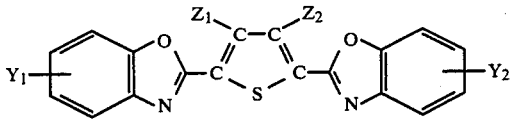

(VII)

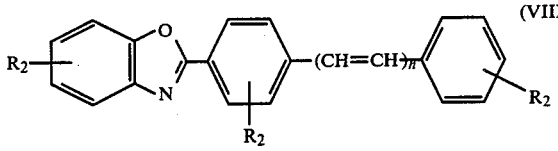

(VIII)

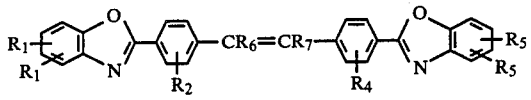

(IX)

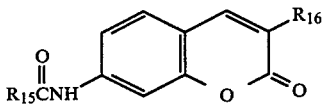

(X)

wherein $Y_1$ and $Y_2$ each represents an alkyl group, $Z_1$ and $Z_2$ each represents hydrogen or an alkyl group, n is 1 or 2, $R_1$, $R_2$, $R_3$, $R_4$ and $R_5$ each represents an aryl group, an alkyl group, an alkoxy group, an aryloxy group, a hydroxyl group, an amino group, a cyano group, a carboxyl group, an amide group, an ester group, and alkylcarbonyl group, an alkylsulfo group, a dialkylsulfonyl group or a hydrogen atom, $R_6$ and $R_7$ each represents a hydrogen atom, an alkyl group, or a cyano group, $R_{16}$ represents a phenyl group, a halogen atom or an alkyl substituted phenyl group, $R_{15}$ represents an amino group or an organic primary or secondary amino group.

13. A method as claimed in claim 12, wherein fixing and water washing are further carried out after the black-and-white development.

14. A method as claimed in claim 13, wherein the silver halide photographic printing paper is processed with an automatic developing apparatus and the washing time is 30 seconds or less.

15. A method as claimed in claim 13, wherein the silver halide photographic printing paper is processed with an acid hardening fixing bath containing at least one polyvalent metal.

16. A method as claimed in claim 15, wherein the polyvalent metal is aluminum.

17. A method as claimed in claim 16, wherein the amount of aluminum used is in a range of 0.1 to 10 g/l—Fixer.

18. A method as claimed in claim 12, wherein the water insoluble fluorescent whitening agent is used in a range of 3 to 200 $mg/m^2$.

19. A method as claimed in claim 12, wherein the sensitizing dyes represented by general formulae I and II are used in an amount of about $2\times10^{-6}$ to $8\times10^{-3}$ mol per mol of silver halide in the silver halide emulsion.

* * * * *